United States Patent [19]

Morehead

[11] Patent Number: 4,537,326

[45] Date of Patent: Aug. 27, 1985

[54] PROTECTOR FOR DRINK OPENING

[76] Inventor: Clyde D. Morehead, 4 Oak Meadow, Evansville, Ind. 47711

[21] Appl. No.: 560,844

[22] Filed: Dec. 13, 1983

[51] Int. Cl.[3] ..... B65D 17/32; B65D 17/34; B65D 47/04

[52] U.S. Cl. ..... 220/269; 220/90.2; 220/90.4; 220/270; 220/359; 222/189; 222/478; 222/541; 229/7 R

[58] Field of Search ..... 220/269, 375, 270, 359, 220/345, 336, 90.2, 90.4, 90.6; 229/7 R; 222/189, 484, 482, 481, 478, 541, 565

[56] References Cited

U.S. PATENT DOCUMENTS

| | | | |
|---|---|---|---|
| 2,646,200 | 7/1953 | Atkins | 229/7 R |
| 2,927,695 | 3/1960 | Bartolomeo | 229/7 R X |
| 2,940,645 | 6/1960 | Albiani | 222/565 X |
| 3,292,828 | 12/1966 | Stuart | 220/359 X |
| 3,717,279 | 2/1973 | Patarini et al. | 220/269 |
| 3,883,034 | 5/1975 | Rausing | 222/541 X |
| 3,938,695 | 2/1976 | Ruff | 222/565 X |
| 4,000,838 | 1/1977 | Bogert | 222/541 X |
| 4,029,033 | 6/1977 | Kerwin et al. | 222/541 X |
| 4,046,283 | 9/1977 | Lockwood | 220/270 |
| 4,083,471 | 4/1978 | Frank | 220/269 |
| 4,162,742 | 7/1979 | Vogt | 220/269 |
| 4,234,099 | 11/1980 | Tarro | 220/270 X |
| 4,463,866 | 8/1984 | Mandel | 220/269 |

*Primary Examiner*—Allan N. Shoap
*Attorney, Agent, or Firm*—Larson and Taylor

[57] ABSTRACT

A protector for an opening in a liquid container is provided to prevent entry into the container by dangerous insects such as bees and the like while allowing the user to drink from the container through the protector. The protector includes a flat cover having a number of small apertures therein. The protector also includes a mechanism for mounting the cover to the container over the drink opening. In one embodiment of the invention, the protector is adhesively attached over the drink opening. In another embodiment, the flat cover is part of a tab opening device which can be locked over the drink opening after the opening is made.

10 Claims, 18 Drawing Figures

PROTECTOR FOR DRINK OPENING

FIELD OF THE INVENTION

The present invention relates generally to liquid containers, and more particularly to an apertured cover for a drink opening in a liquid container.

BACKGROUND OF THE INVENTION

When consuming a canned or bottled beverage, particularly outdoors, there is frequently encountered the problem of insects such as bees or the like flying into the opening of the bottle or can. Besides the unappetizing nature of this occurence, there is the additional problem that the insect such as a bee can be subsequently be carried into the mouth of an unsuspecting user drinking from the container. This could be a significant problem where the insect is a bee as the bee may then sting the user. In fact, there are cases where a bee has stung the inside of the mouth or throat of a user and the user died as a result of this.

There has been disclosed in the prior art various closures which are adapted to engage a drink opening, particularly canned drinks. Typical of these closures are those disclosed in the following U.S. Pat. Nos.: 3,952,914 (Vogt), 3,804,287 (Balocca et al), 3,622,034 (Lutzker et al), 3,952,911 (Bozek et al), 4,103,804 (Fournier et al), 4,164,303 (Waterbury), 4,165,016 (Moller), and 4,232,797 (Waterbury). The closures disclosed in these patents serve to help preserve the liquid contents of the can after opening, but must be removed in order to allow the contents to be emptied or drunk from the can.

The use of a screen or the like adjacent the opening of a can has been disclosed in U.S. Pat. No. 4,240,568 (Pool). However, the screen disclosed in this patent is merely acting as a filter for the contents poured from the container and is not adapted to be used nor usable with a drink opening.

Thus, it can be seen that there exists a need in the prior art for a protector which prevents insects such as bees and the like from entering a liquid container but which allows the opening of the liquid container to be readily used by the consumer.

SUMMARY OF THE INVENTION

In accordance with the present invention, a protector for the opening in a liquid container is provided which prevents dangerous insects and the like from entering the container through the drink opening but which allows the user to drink the liquid in the container through the opening and protector. The protector includes a flat cover which has a plurality of small apertures therein. A mounting means is provided for mounting the cover to the container over the drink opening.

In one embodiment of the present invention, the flat cover includes a peripheral portion which surrounds the opening. The mounting means is then an adhesive located on this peripheral portion which holds the flat cover around the opening. Where the container is a can having a removable pull tab opening device, the cover is mounted on the interior side of the opening. Alternately, where the container has some sort of movable closure for the opening, a releasable mounting area can be provided on the container to initially mount the flat cover adhesively. After opening of the container, the cover is removed from the mounting area and adhesively attached about the exterior periphery of the opening of the container. Preferably, a tab portion projecting outwardly from the edge of the cover is provided to facilitate removal of the cover from the mounting area. The flat cover in this embodiment is conveniently made of a strip of aluminum foil or a strip of plastic.

In another embodiment of the present invention, the container is a can having a tab opening device including a tab actuator and a shearable closure which is displaced by the tab actuator to expose the can opening. In this embodiment the flat cover is a portion of the tab actuator and the mounting means includes a locking means for locking the flat cover in position over the can opening. In one preferred embodiment, the tab actuator is of the type which is elongated and attached to the top of the can by a rivet at one end of the actuator so that the actuator acts as a lever about the rivet to push the shearable closure into the can interior. In this preferred embodiment, the locking means includes a respective lock member located on each lateral side of the flat cover. The lock members engage respective lateral sides of the can opening to hold the flat cover in place. In order to move the flat cover into position, the flat cover is rotated about the rivet into position over the can opening and the lock members are flanges which are then located underneath respective lateral sides of the can opening. Alternately, where the tab actuator is pivoted upwardly from the can, the flat cover portion is further pivoted over on top of the can opening and the lock members are respective catch means resiliently mounted on respective lateral sides of the cover which catch under the respective lateral edges of the can opening.

In another preferred embodiment of the present invention, the tab opening device is of the type where the tab actuator is removable from the can together with the shearable closure which is attached at one end of the tab actuator. As with one of the embodiments described above, the tab actuator includes the flat cover having apertures therein. A mounting means is then provided which includes a flange extending laterally from the flat cover on the end opposite from the shearable closure. With this construction, the flat cover is locked in the can opening by locating the shearable closure underneath one edge of the can opening and the flange underneath an opposite edge of the can opening. Preferably, the plurality of small apertures in the flat cover are slots formed therein.

It is a feature of the present invention that a protector for the drink opening of a container which can be easily and quickly applied to the drink opening by the user is provided.

It is another feature of the present invention that the protector provided with the container is easily and unobtrusively carried by the container.

It is still another feature of the present invention that the protector is inexpensively manufactured and provided on the container.

Other features and advantages of the present invention are stated in or apparent from a detailed description of presently embodiments of the invention found hereinbelow.

DETAILED DESCRIPTION OF THE PREFERRED EMBODIMENTS

Figure 1:
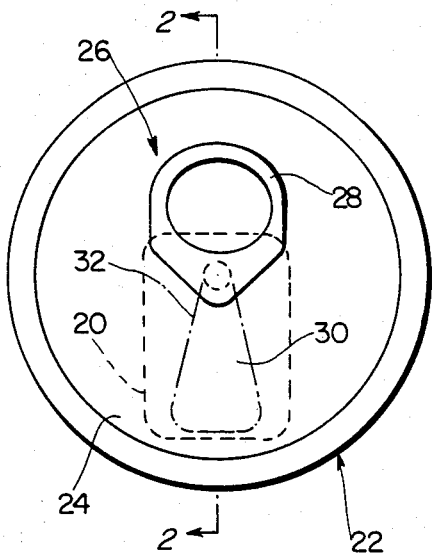
FIG. 1 is a top plan view of a can lid having a protector according to a first embodiment of the present invention.
Figure 2:
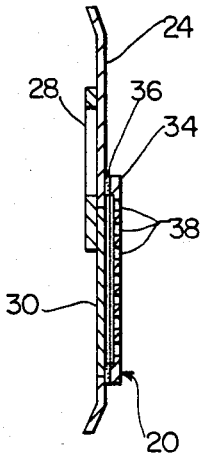
FIG. 2 is a cross-sectional view of the can lid depicted in FIG. 1 taken along the line 2—2.
Figure 3:
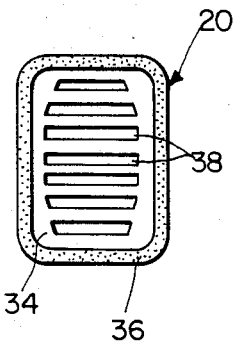
FIG. 3 is a top plan view of the protector depicted in FIG. 1.

With reference now to the drawings in which like numerals represent like elements throughout the several views, a first embodiment of a protector 20 for a can 22 is depicted in FIGS. 1 to 3. Can 22 is typically a soft drink can or the like having a lid 24 provided with a tab opening device 26. Tab opening device 26 is typical of that type of device well known in the art including a pull ring 28 and removable tab 30. When tab opening device 26 is actuated, tab 30 is removed to provide a drink opening 32 which is schematically indicated in FIG. 1.

As shown best in FIGS. 2 and 3, protector 20 includes a base 34 of generally rectangular shape. Located on one side of base 34 around the periphery thereof is a layer of adhesive 36. A plurality of slots 38 are provided in base 34 as shown.

In operation, protector 20 functions in the following manner. Initially, protector 20 is formed as shown in FIG. 3 and is attached to the interior side of lid 24 by use of adhesive 36. Can 22 including lid 24 is then manufactured in the normal manner to contain an appropriate liquid. As protector 22 is exposed to the liquid in can 22, protector 20 is made of an inert material, such as aluminum foil or a strip of plastic. Similarly, adhesive 36 must be inert or nonreactive with the liquid in can 22.

When the user desires the drink from can 22, tab opening device 26 is operated in the normal manner. By grasping pull ring 28, tab 30 is torn or sheared from lid 24 to produce drink opening 32. Attached around drink opening 32 on the interior side of lid 24 is protector 20. Thus, the user drinks from can 22 through drink opening 32 in the normal manner as the liquid easily passes through slots 38 provided in protector 20. However, insects such as bees or the like are prevented from entering the interior of can 22 by protector 20.

Figure 4:
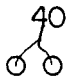
FIGS. 4 and 5 are plan views of alternative embodiments of apertures which can be provided in a protector according to the present invention.
Figure 5:
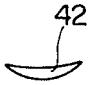

Depicted in FIGS. 4 and 5 are alternative apertures which can be provided in protector 20 in place of slots 38. Depicted in FIG. 4 are holes 40 which can be provided in a series in base 34 in place of the series of slots 38. FIG. 5 shows a curved slot 42 which can alternately be used in place of slots 38 and base 34. It should be appreciated that other apertures can be provided besides those depicted.

Figure 6:
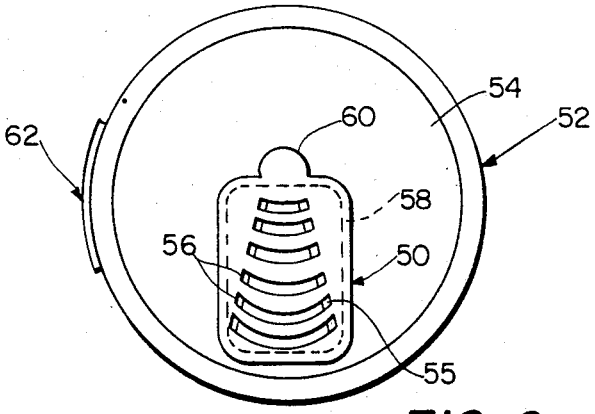
FIG. 6 is a top plan view of a can lid having a protector according to a second embodiment of the present invention.

Depicted in FIG. 6 is an alternative embodiment of a protector 50 which is in place on a can 52 having a lid 54 and a drink opening 55. Protector 50 is basically similar to protector 20 and includes a plurality of slots 56 and a peripheral layer of adhesive 58. Protector 50 also includes a tab portion 60 extending from one longitudinal side thereof. Located on one side of can 52 is a releasable area 62 to which protector 50 is initially adhesively attached. Releasable area 62 is simply a portion of the side of can 52, or a separate layer of material which is attached to the side of can 52.

In operation, protector 50 is used in the following manner. Initially, can 52 is provided with a releasable area 62 on which protector 50 is adhesively attached. Lid 54 is provided with a suitable tab opening device which covers drink opening 55. When it is desired to drink the liquid in can 52, the tab opening device is operated to form drink opening 55. At that time, protector 50 is peeled from releasable area 62 by grasping tab portion 60. Protector 50 is then placed over drink opening 55 as shown in FIG. 6. Adhesive 58 holds protector 50 over drink opening 55 so that insects such as bees or the like cannot enter can 52. However, the user easily drinks from can 52 through drink opening 55 and slots 56 provided in protector 50. It should be appreciated that releasable area 62 can be provided in any location on can 52 which is convenient, or even on a separate card or the like provided to the consumer.

Figure 7:
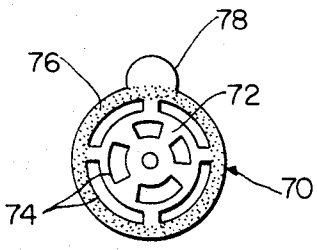
FIG. 7 is a bottom plan view of a protector according to the present invention which is useable with a bottle top.

Depicted in FIG. 7 is a protector 70 for use on a bottle or the like in a manner similar to protector 50. Protector 70 includes a base 72 which is provided with a series of circular slots 74. Provided around the periphery of base 72 is a layer of adhesive 76. Base 72 also includes an extension or tab 76 by which the user can grasp protector 70.

In operation, protector 70 functions in a manner substantially similar to protector 50. Thus, protector 70 is initially provided on a releasable area located on the bottle to be covered. After the bottle is opening, tab 78 is grasped to peel protector 70 from the releasable area. Protector 70 is then applied over the bottle opening with adhesive 76 holding protector 70 in place. The user can then drink from the bottle opening through slots 74 provided in protector 70. However, insects such as bees or the like are prevented from entering the bottle through protector 70.

Depicted in FIGS. 8 to 12 is a protector 80 which is a third alternative embodiment of the present invention. In this embodiment, protector 80 is a portion of a tab opening device 82 which is provided for lid 84 of can 86. Tab opening device 82 is of the type well known in the art which includes a shearable tab 88 which is pivoted into can 86 along one edge by the pivoted raising of a tab actuator 90 to form drink opening 89. Tab actuator 90 is pivotably attached to lid 84 by a flexible hinged portion 92 located adjacent shearable tab 88. Tab actuator 90 also includes a nose 94 which pivots downwardly into shearable tab 88 as the opposite end of tab actuator 90 is raised.

Tab actuator 90 is also provided with two apertures 96 and 98 as shown. Apertures 96 and 98 are partially covered by extensions 100 so as to provide slots 102 over apertures 96 and 98.

Figure 9:
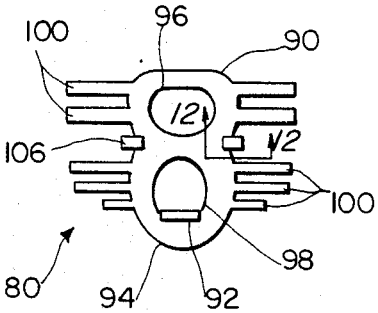
FIG. 9 is a top plan view of the protector depicted in FIG. 8 prior to the forming of the slots.
Figure 10:
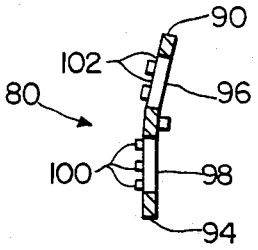
FIG. 10 is a cross-sectional view of the protector depicted in FIG. 8 taken along the line 10—10.
Figure 11:
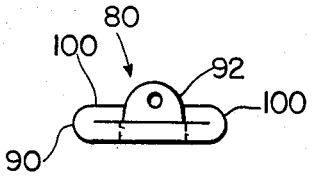
FIG. 11 is a front elevation view of the protector depicted in FIG. 9 after formation of the slots.

As shown in FIG. 9, extensions 100 are preferably integrally formed with tab actuator 90 during a stamping operation. Extensions 100 are provided in pairs on opposite sides of tab actuator 90 and are subsequently bent toward one another as shown in FIG. 11. The ends of the pairs of extensions 100 touch or almost touch so that slots 102 are formed in tab actuator 90.

Figure 8:
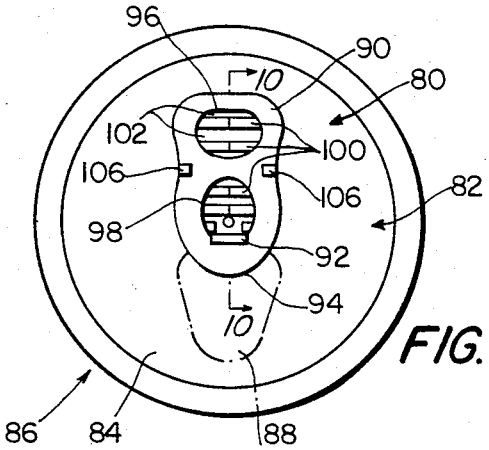
FIG. 8 is a top plan view of a can lid having a protector according to a third embodiment of the present invention.
Figure 12:
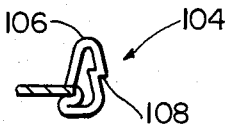
FIG. 12 is a cross-sectional view of a portion of the protector depicted in FIG. 9 taken along the line 12—12.

With reference to FIG. 12, a mounting means 104 is also provided on tab actuator 90 to hold tab actuator 90 in place to form protector 80. Mounting means 104 includes a catch member 106 which is suitably shaped from an integral strip of tab actuator 90. Catch member 106 includes a latch 108 as shown. It should be appreciated that a catch member 106 is provided on either side of tab actuator 90 as depicted in FIGS. 8 and 9.

In operation, protector 80 functions in the following manner. Initially, tab actuator 90 is manufactured as described above to include extensions 100 folded underneath of tab actuator 90 to form slots 102. In addition, catch members 106 are formed on either side of tab actuator 90. Tab actuator 90 is then supplied as part of tab opening device 82 which is included on lid 84 as can 86 is manufactured to contain a liquid. Upon actuation of tab opening device 82, tab actuator 90 is pivoted about hinged portion 92 to force nose 94 into shearable tab 88. This causes shearable tab 88 to shear away from the rest of lid 84 along three sides and pivot into the interior or can 86 along the other side. This produces drink opening 89. Tab actuator 90 is then further pivoted about hinged portion 92 until tab actuator 90 rests against lid 84 over top of drink opening 89. As this occurs, latches 108 resiliently pass under lateral edges of drink opening 89 so that latch members 108 catch on the underside of the edges of drink opening 89. Consequently, catch members 106 hold tab actuator 90 in place over drink opening 89 and thus protector 80 is provided over drink opening 89. As with the other embodiments, protector 80 allows the user to drink freely from drink opening 89 of can 86, while preventing insects such as bees or the like from entering can 86.

Figure 13:
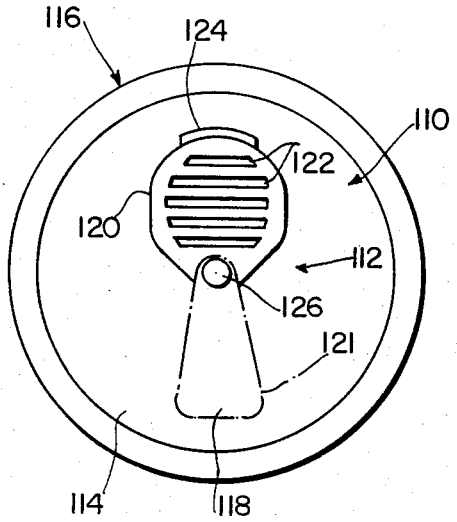
FIG. 13 is a top plan view of a can lid having a protector according to a fourth embodiment of the present invention.
Figure 14:
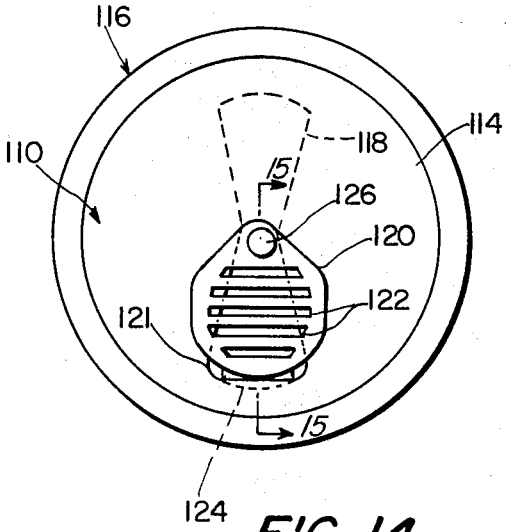
FIG. 14 is a top plan view of the can lid depicted in FIG. 13 having the protector in place.
Figure 15:
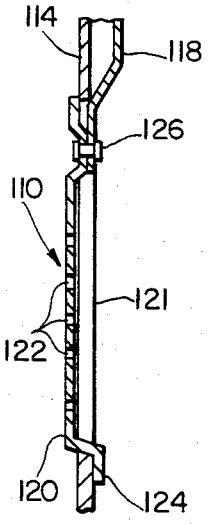
FIG. 15 is a cross-sectional view of the can lid and protector depicted in FIG. 14 taken along the line 15—15.

Depicted in FIGS. 13, 14 and 15 is a fourth alternative embodiment of a protector 110. In this embodiment, protector 110 is part of tab opening device 112 which is provided on lid 114 of can 116. Tab opening device 112 includes a removable tab 118 and a pull ring 120. When removable tab 118 is sheared from lid 114, drink opening 121 is provided in lid 114.

Tab opening device 112 is typical of those types of devices well known in the art and is similar to tab opening device 26 described above. However, pull ring 120 has a plurality of slots 122 provided where a large aperture would normally be located. In addition, a small flange 124 extends longitudinally from pull ring 120 on the opposite side of pull ring 120 from tab 118. As shown best in FIG. 15, removable tab 118 is connected to pull ring 120 by a rivet 126.

In operation, protector 110 functions in the following manner. Initially, tab opening device 112 is provided on lid 114 to form a can 116 for holding a drinkable liquid. When it is desired to drink from can 116, pull ring 120 is grasped by the user and lifted and pulled to remove tab 118 from lid 114 and thereby form drink opening 121 in lid 114. Pull ring 120 is then inverted and removable tab 118 inserted in drink opening 121 with pull ring 120 approximately parallel to lid 114. Pull ring 120 is then pushed radially toward the center of lid 114 with pull ring 120 riding over the exterior surface of lid 114 and removable tab 118 sliding under the interior side of lid 114. In this manner, depending flange 124 is eventually brought to a position where flange 124 can be depressed below the lower edge of the adjacent edge of drink opening 121. When this occurs, pull ring 120 is moved radially outward slightly to trap flange 124 beneath the interior side of lid 114 as depicted in FIGS. 14 and 15. Pull ring 120 is then locked in place by the trapping of flange 124 and removable tab 118 and serves as protector 110 to allow the user to drink through drink opening 121 while preventing insects such as bees or the like from entering can 116.

Figure 16:
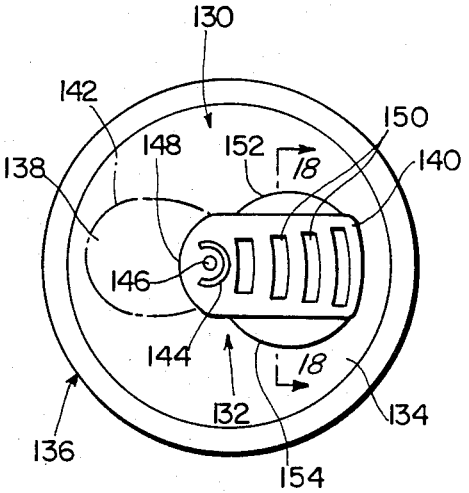
FIG. 16 is a top plan view of a can lid having a protector according to a fifth embodiment of the present invention.
Figure 17:
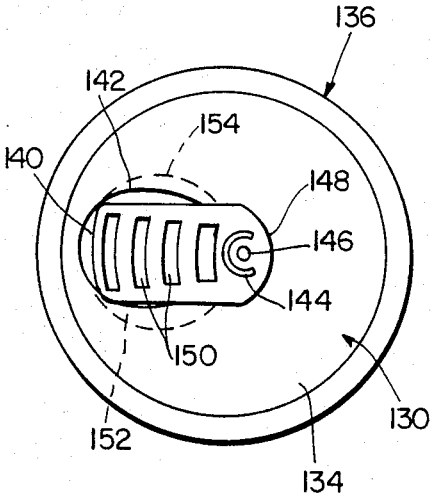
FIG. 17 is a top plan view of the can lid depicted in FIG. 16 with the protector in position.
Figure 18:
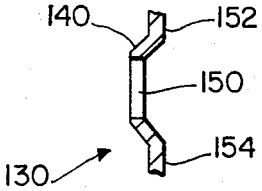
FIG. 18 is a cross-sectional view of the protector depicted in FIG. 16 taken along the line 18—18.

Depicted in FIGS. 16, 17 and 18 is a fifth embodiment of a protector 130. Protector 130 is part of a tab opening device 132 which is provided on a lid 134 of a can 136. Tab opening device 132 is similar in operation to tab opening device 82 and includes a shearable tab 138 which is depressed into can 136 by a tab actuator 140 to provide a drink opening 142. Tab actuator 140 includes a hinged portion 144 which is attached to lid 134 by a rivet 146. Tab actuator 140 also includes a nose 148 which is pressed into contact with shearable tab 138 to push shearable tab 138 into the interior of can 136. The other end of tab actuator 140 is provided with a series of slots 150 as shown. Located on the lateral sides of tab actuator 140 are offset flanges 152 and 154 whose offset toward lid 134 is shown best in FIG. 18.

In operation, protector 130 functions in the following manner. Initially, tab opening device 132 is provided on lid 134 as can 136 containing a drinkable liquid is formed. Next, when it is desired to drink from can 136, tab actuator 140 is lifted so as to pivot about hinged portion 144 and push nose 148 into shearable tab 138. This causes shearable tab 138 to shear away from lid 134 and be depressed into the interior of can 136 to create drink opening 142.

After drink opening 142 is provided, tab actuator 140 is pivoted back to the original position adjacent and parallel to lid 134. Tab actuator 140 is then rotated about rivet 146 parallel to lid 134 until tab actuator 140 is almost located vertically above drink opening 142. At this time, tab actuator 140 is depressed slightly so that one of offset flanges 152 or 154 passes laterally underneath of an adjacent edge of drink opening 142 as tab actuator 140 is further rotated. When tab actuator 140 can be rotated no further because offset flange 152 or 154 contacts the edge of drink opening 142, the other of flanges 152 or 154 is located at a position to be depressed below the level of the other lateral side of drink opening 142. After this is accomplished, tab actuator 140 is rotated slightly in the other direction to locate both flanges 152 and 154 under respective lateral edges of drink opening 142. In this position, tab actuator 140 is locked in position over drink opening 142 to provide protector 130 for can 136. As with the other protectors, protector 130 allows the user to drink through drink opening 142 and slots 150 of tab actuator 140 while preventing insects such as bees or the like from entering the interior of can 136.

Although the present invention has been described with respect to exemplary embodiments thereof, it will be understood by those of ordinary skill in the art that variations and modifications can be effected within the scope and spirit of the invention.

I claim:

1. A protector for a drink opening in a liquid container comprising, a removable closure for the opening in the container, a flat cover having a plurality of small apertures therein and a peripheral portion surrounding the apertures, mounting means comprising an adhesive located on said peripheral portion for mounting the cover to the container, a releasable mounting area located on the container where the cover is initially mounted prior to removal of the closure whereby after removal of the closure the cover is removed from said mounting area and adhesively attached about the exterior periphery of the opening of the container so that dangerous insects and the like are prevented from entering the container through the drink opening by said cover but the liquid in the container is capable of passing through said cover.

2. A protector as claimed in claim 1 wherein said cover includes a tab portion projecting outwardly from the edge of said cover to facilitate removal of said cover from said mounting area.

3. A protector for a drink opening in a liquid container comprising, a tab opening device including a tab actuator and a shearable closure which is displaced by the tab actuator to expose the can opening, the tab actuator having a portion thereof including a flat cover having a plurality of samll apertures therein, mounting means for mounting said cover to the container over the drink opening, said mounting means including a locking means for locking said flat cover in position over the opening whereby dangerous inserts and the like are prevented from entering the container through the drink opening by said cover but the liquid in the container is capable of passing through said cover.

4. A protector as claimed in claim 3 wherein the tab actuator is elongated and is attached adjacent one end to the can by a rivet to act as a lever about the rivet to push the shearable closure into the can interior, and wherein said locking means includes a respective lock member located on each lateral side of said flat cover which engage a respective lateral side of the can opening to hold said flat cover in place.

5. A protector as claimed in claim 4 wherein the tab actuator is rotated about the rivet parallel to the plane of the can opening to bring said flat cover adjacent the can opening, and wherein said lock members are flanges which are located underneath respect lateral edges of the can opening to lock said flat cover in position over the can opening.

6. A protector as claimed in claim 4 wherein the tab actuator is pivoted about the attachment to the rivet having an axis parallel to the plane of the can opening, and wherein said lock members are catch means resiliently mounted on respective lateral sides of said flat cover for catching under respective lateral edges of the can opening to lock said flat cover in position over the can opening.

7. A protector as claimed in claim 6 wherein said plurality of small apertures are slots which are formed from a large aperture in said flat cover and a plurality of fingers which are integrally formed with said flat cover and which extend across said large aperture in a parallel, spaced relationship.

8. A protector as claimed in claim 7 wherein said fingers extend laterally away from said flat cover and are bent back across said large aperture to form said slots.

9. A protector as claimed in claim 3 wherein the tab actuator is removable from the can together with the shearable closure which is attached at one end to the tab actuator, and wherein said mounting means includes the shearable closure and a flange extending longitudinally from said flat cover on the opposite side of said flat cover from the shearable closure whereby said flat cover is locked over the can opening by locating the shearable closure underneath one edge of the can opening and said flange underneath an opposite edge of the can opening.

10. A protector as claime claim 9 wherein said plurality of small apertures are slots formed in said flat cover.

* * * * *